US006789294B2

(12) United States Patent
Panek et al.

(10) Patent No.: US 6,789,294 B2
(45) Date of Patent: Sep. 14, 2004

(54) SELF-FASTENING HANDLE ASSEMBLY

(75) Inventors: Jeffrey J. Panek, N. Kingstown, RI (US); Peter D. Tata, Johnston, RI (US); James W. Carpenter, Wakefield, RI (US)

(73) Assignee: Cool Options, Inc., Warwick, RI (US)

( * ) Notice: Subject to any disclaimer, the term of this patent is extended or adjusted under 35 U.S.C. 154(b) by 0 days.

(21) Appl. No.: 10/248,307

(22) Filed: Jan. 7, 2003

(65) Prior Publication Data

US 2003/0126721 A1 Jul. 10, 2003

Related U.S. Application Data

(60) Provisional application No. 60/346,532, filed on Jan. 8, 2002.

(51) Int. Cl.[7] ..... A45C 13/26
(52) U.S. Cl. ..... 16/409; 16/445
(58) Field of Search ..... 16/408, 409, 418, 16/444, 445

(56) References Cited

U.S. PATENT DOCUMENTS 4,799,306 A * 1/1989 Collins et al. ..... 29/453
6,415,478 B1 * 7/2002 Watanabe et al. ..... 16/444

* cited by examiner

*Primary Examiner*—Robert E. Pezzuto
*Assistant Examiner*—Tara L. Mayo
(74) *Attorney, Agent, or Firm*—Barlow, Josephs & Holmes, Ltd.

(57) ABSTRACT

The self-fastening handle assembly includes a carrier panel with an aperture. A base member has a central bore and a bottom surface. Fingers, which extend from the bottom surface of the base member, are in a first arrangement which has a diameter which is smaller than the diameter of the aperture and thereby capable of being routed therethrough. The fingers are expandable from the first arrangement to a second arrangement having a diameter greater than the diameter of the aperture. A spreader pin resides within the bore and within the fingers. The spreader pin is movable from a first position with the fingers at the first arrangement to a second position within the fingers to a second arrangement with the finger engaging surface in communication with the fingers. A handle, pivotally connected to the base member by a pivot; has an impact end which drives the spreader pin into the fingers upon rotation of the handle. As a result, the fingers spread on the opposing side of the carrier panel thus securing the base member and handle thereto.

19 Claims, 7 Drawing Sheets

SELF-FASTENING HANDLE ASSEMBLY

CROSS REFERENCE TO RELATED APPLICATIONS

This application claims the benefit of U.S. provisional patent application No. 60/346,532 having a filing date of Jan. 8, 2002.

BACKGROUND OF INVENTION

The present invention relates generally to handle hardware and to handle hardware that is self-fastening that obviates the needs for installation tools.

Handles are commonly affixed to a panel or substrate for the purposes of facilitating the movement of that panel or substrate. For example, handles are often attached to drawers to assist in moving them in and out. Also, handles are commonly affixed to objects to facilitate moving them. As a further example, heavy duty handles are attached to the cabinet panel for a piece of equipment, such as an audiovisual component, so that it can be more easily lifted and transported.

in the prior art, handles are typically attached to their given panel support by a threaded fastener or rivet. For example, in the prior art, a handle of a U-shaped configuration has two free ends that carry male threading. The free ends are routed through corresponding apertures it the substrate. A female threaded nut is provided on the opposite side of the substrate to engage with the male threaded free ends to thereby secure the handle in place. Alternatively, the free ends of the handles may include female threaded bores for aligning with corresponding apertures through the panel on which the handle is to be attached. Male threaded fasteners are routed respectively through the holes in the panel to engage with the female threaded bores in the free ends of the handles. The heads of the fasteners on the opposing side of the panel to the handle itself secure the handle in place on the panel.

Still further, handles may be secured to a panel by other connection methods, such as rivets cotter pins. Alternatively, handles may be directly welded to the face of the panel.

As can be understood these prior art attachment methods are labor intensive, require access to the rear of the panel that will carry the handle and are time consuming. In many applications, it is desirable to ship the product without the handle or handles attached thereto to save cost and time of assembly thereby requiring the end users or purchaser to finish the assembly by attaching the desired handle. However, at this point, the product, such as an electronic stereo component, is an enclosed unit making it difficult if not impossible to gain access to the rear, internal side of the panel, e.g. a front face of the unit. Furthermore, it is also not desirable to weld a handle to a panel that resides on a delicate product.

In view of the foregoing, there is a demand for a handle that can be attached quickly and easily without additional hardware or tools and without the need for access to the rear of the panel that is to carry the handle. There is a further demand for a handle to be self-fastening yet provide a permanent installation of the handle to the carrier panel.

SUMMARY OF INVENTION

The present invention preserves the advantages of prior art handles and methods of manufacturing and the installing the same. In addition, the improved self-fastening handle and manufacturing and installation methods of the present invention provides new advantages not found in currently known assemblies and methods and overcomes many disadvantages of such currently available assemblies and methods.

The invention is generally directed to the novel and unique self-fastening handle as well as the novel and unique method of installation of the handle to a carrier panel. The self-fastening handle assembly of the present invention includes a carrier panel with an aperture. A base member has a central bore and a bottom surface. Fingers, which extend from the bottom surface of the base member, are in a first arrangement which has a diameter which is smaller than the diameter of the aperture and thereby capable of being routed therethrough. The fingers are expandable from the first arrangement to a second arrangement having a diameter greater than the diameter of the aperture. A spreader pin resides within the bore and within the fingers. The spreader pin is movable from a first position with the fingers at the first arrangement to a second position within the fingers to a second arrangement with the finger engaging surface in communication with the fingers. A handle, pivotally connected to the base member by a pivot; has an impact end which drives the spreader pin into the fingers upon rotation of the handle. As a result, the fingers spread on the opposing side of the carrier panel thus securing the base member and handle thereto.

In an alternative embodiment, the spreader pin and the impact end of the handle are integrated so that the impact end is driven into the central bore of the base member to directly spread the fingers emanating from the bottom of the base member.

A method of the present invention includes providing a carrier panel with an aperture with a diameter therethrough. The base member has a central bore and a bottom surface with a number of fingers extending from the bottom surface of the base member. The spreader pin resides within the bore and within the fingers; the spreader pin having a top surface and a finger engaging surface. The fingers are routed through the aperture in the carrier panel and the handle is rotated relative to the base member so that the impact end of the handle impact into the spreader pin. Next, the spreader pin is driven into the fingers to thereby spread the fingers to the second arrangement which has a diameter greater than the diameter of the aperture in the carrier panel thereby preventing detachment of the base member from the carrier panel. As a result, the base member is secured to the carrier panel and the handle pivotally connected thereto.

In the alternative method of the present invention, the spreader pin and free ends of handle are integrated to form impact ends. The handle is driven into the central bore of the base member without the assistance of the pivoting as in the preferred embodiment of the present invention. In this alternative embodiment, the installer pushes the handle, namely, the impact ends thereof toward the carrier panel after the fingers are positioned within the aperture of the carrier panel. As a result, the fingers will be spread securing the base members and the handle to the carrier panel.

Once the handle is installed in accordance with the present invention, the handle may be used in the normal fashion. For example, with the preferred embodiment of the present invention, the handle is free to pivot to provide low profile handle. When use of the handle is needed, it can be easily pivoted to the desired position. With the alternative embodiment, the handle is permanent positioned in an extended position ready for use.

Accordingly, it is a primary object of the instant invention to provide an improved self-fastening handle.

Another object of the instant invention is to provide a self-fastening handle that does not require tools for installation.

Still further, an object of the instant invention is to provide a self-fastening handle that can be installed without access to the rear side of the carrier panel.

It is yet another object of the present invention to provide a self-fastening handle that requires no extra hardware for installation.

A further object of the present invention is to provide a self-fastening handle that can be installed quickly and easily.

Another object of the present invention is to provide method of installing a self-fastening handle.

BRIEF DESCRIPTION OF DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION

Figure 1:
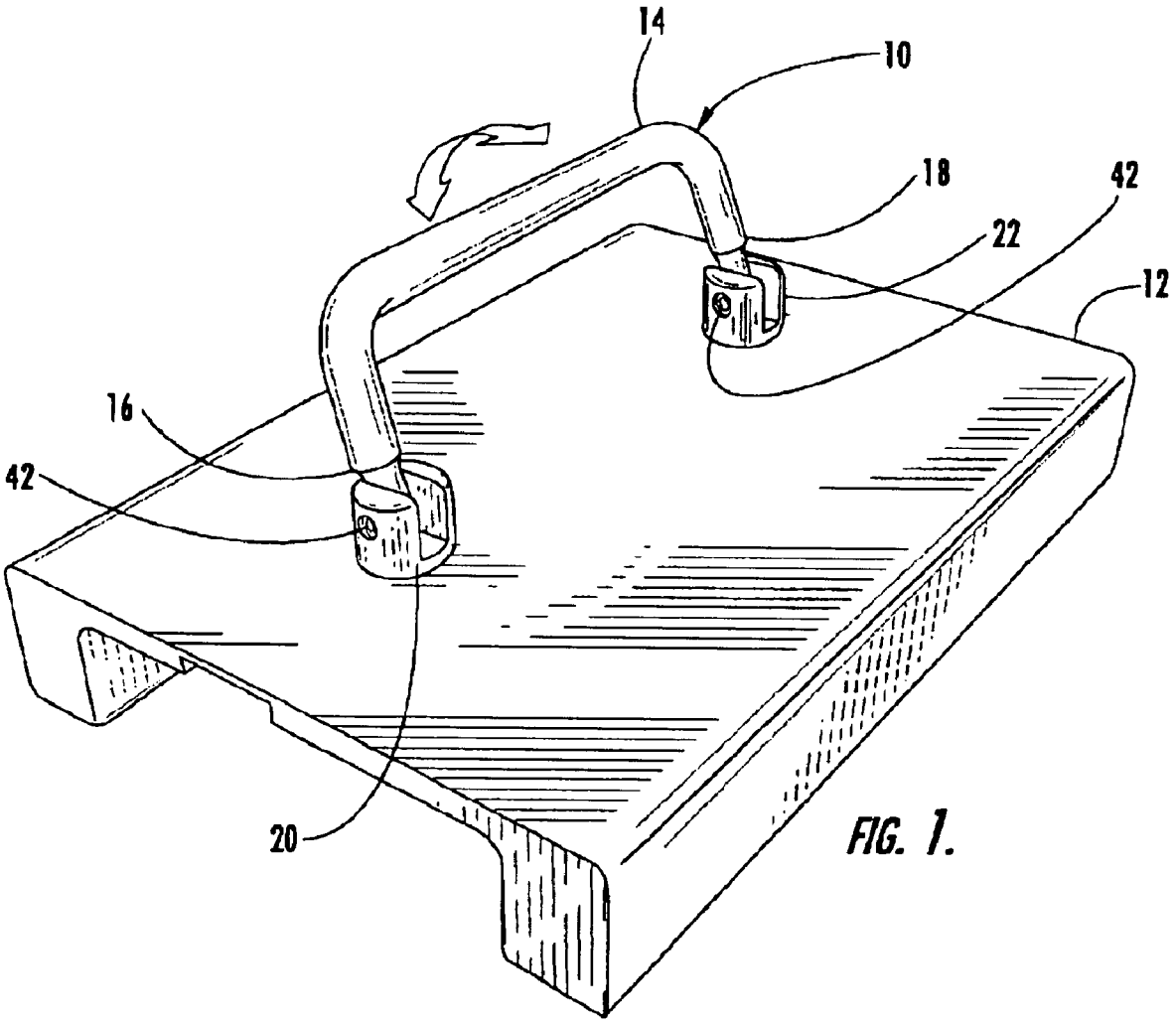
FIG. 1 is a perspective view of the preferred embodiment of the self-fastening handle of the present invention in the process of being installed onto a carrier panel.

Referring first to FIG. 1, a perspective view of the preferred embodiment of the self-fastening handle assembly of the present invention, generally referred to as 10, is shown attached to a carrier panel 12. The carrier panel 12 shown in the figures, by way of example, is a metal drawer face. However, the carrier panel 12 may be any type of panel or plate of any material that requires a handle attached thereto to facilitate movement or handling thereof.

Referring first to FIG. 1, a perspective view of the preferred embodiment of the handle assembly 10 of the present invention is shown. The self-fastening handle assembly 10 is shown installed onto a carrier panel 12. The assembly 10 includes a handle 14 which is preferably of the bail type that has two free ends 16, 18. In the preferred embodiment of the present invention, the free ends 16, 18 are pivotally connected to the carrier panel 12 by respective base members 20, 22 which are directly connected to the carrier panel 12. Details of the construction of the base members 20, 22 and their connection to the carrier panel 12 is shown in detail in FIGS. 2–4.

Figure 2:
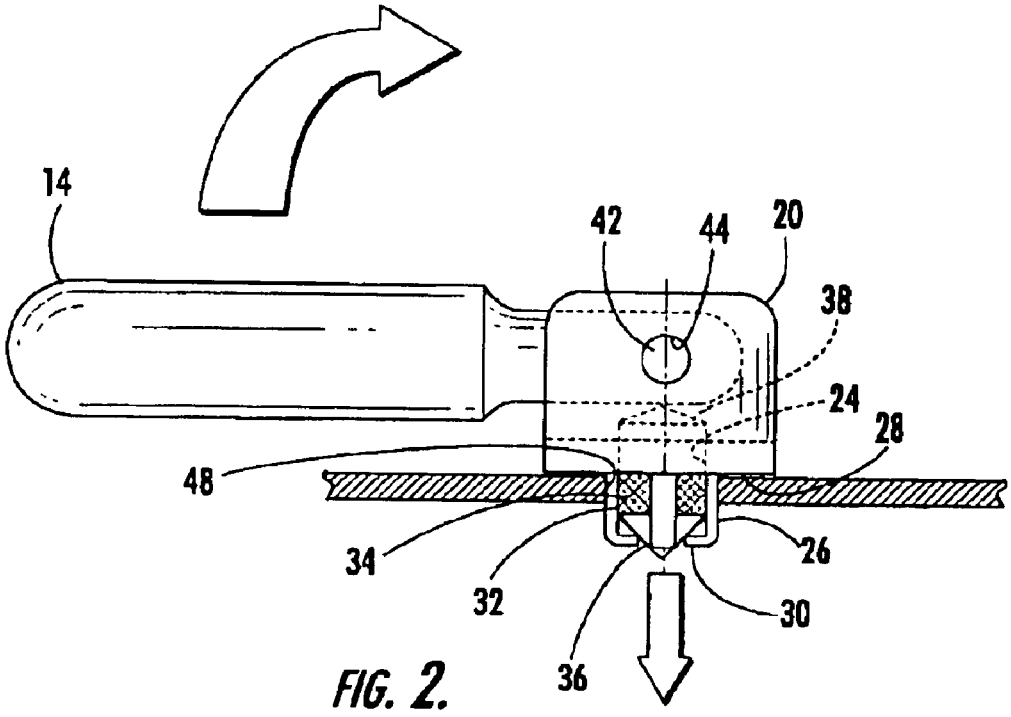
FIG. 2 is a partial cross-sectional view of the self-fastening handle of FIG. 1 in the process of being installed to a carrier panel.

Turning now to FIG. 2, a partial cross-sectional view of the handle assembly 10 of FIG. 1 is shown. In FIG. 2, base member 20 can be seen. The base member 20 includes a central bore 24 that has a number of fingers 26 that extend downwardly from the bottom surface 28 thereof. The fingers 26 preferably have inwardly directed flanges 30 that communicate with the outer surface 32 of a spreader pin 34 which further includes a tapered lower end 36 and a top impact end 38. Other configurations of the fingers 26 can be employed to resiliently communicate with the outer surface 32 of the spreader pin 34. The fingers 26 are arranged to substantially surround the central bore 24 of base member 20. The central bore 24 can also be seen in detail in FIG. 4.

FIG. 2 shows the self-fastening handle assembly 10 prior to attachment to the carrier panel 12. The preferred embodiment includes a bail configuration with two free ends 16, 18. For ease of discussion, connection of one free end 16 of the handle 14 to one base member 20 is shown. Connected of the other free end 18 of the handle 14 to its respective base member 22 is identical thereto.

The spreader pin 34 is positioned within the central bore 24 of the base member 20 with the tapered lower end 36 of the spreader pin 34 residing proximal to the inwardly turned flanges 30 of the fingers 26. The base member 20 is connected to the free end 16 of the handle 14 when the handle 14 is positioned parallel to the bottom surface 28 of the base member 20 and perpendicular to the fingers 26 emanating downwardly therefrom. The free end 16 of the handle 14 includes a transverse bore 40 for receiving a lock pin 42 therethrough.

Figure 3:
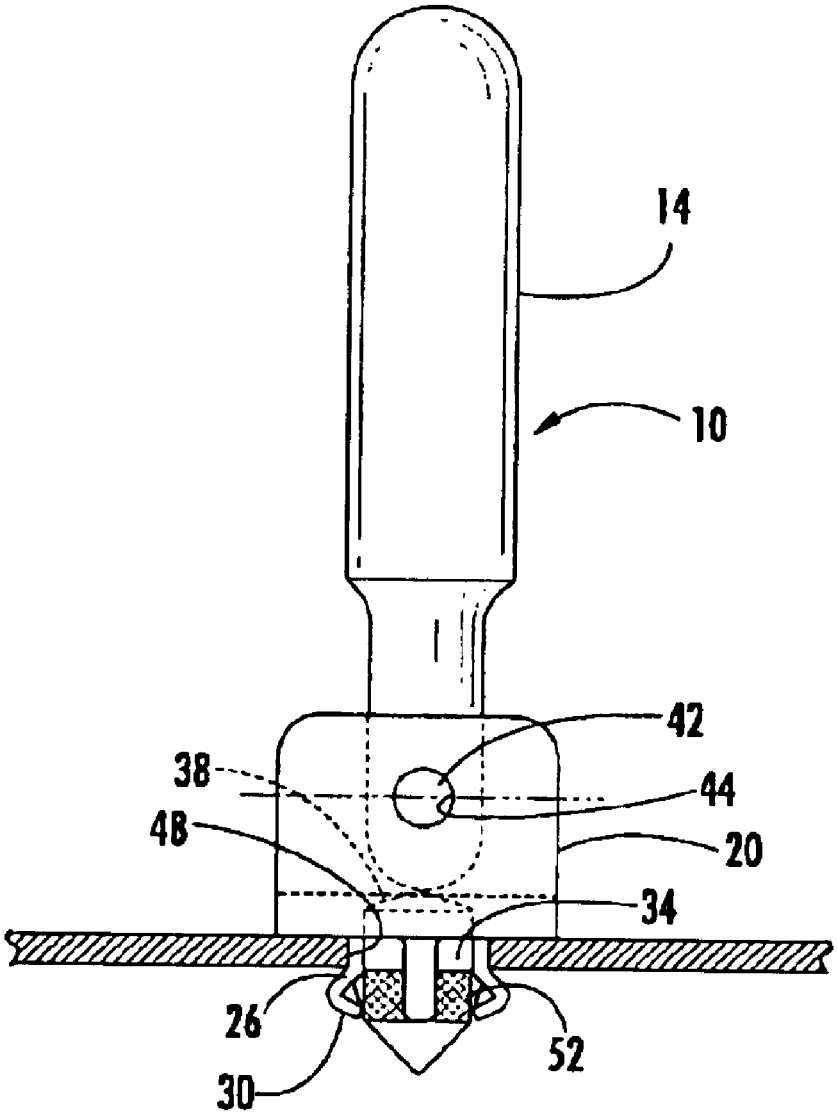
FIG. 3 is a partial cross-section view of the self-fastening handle of FIG. 2 fully installed.
Figure 4:
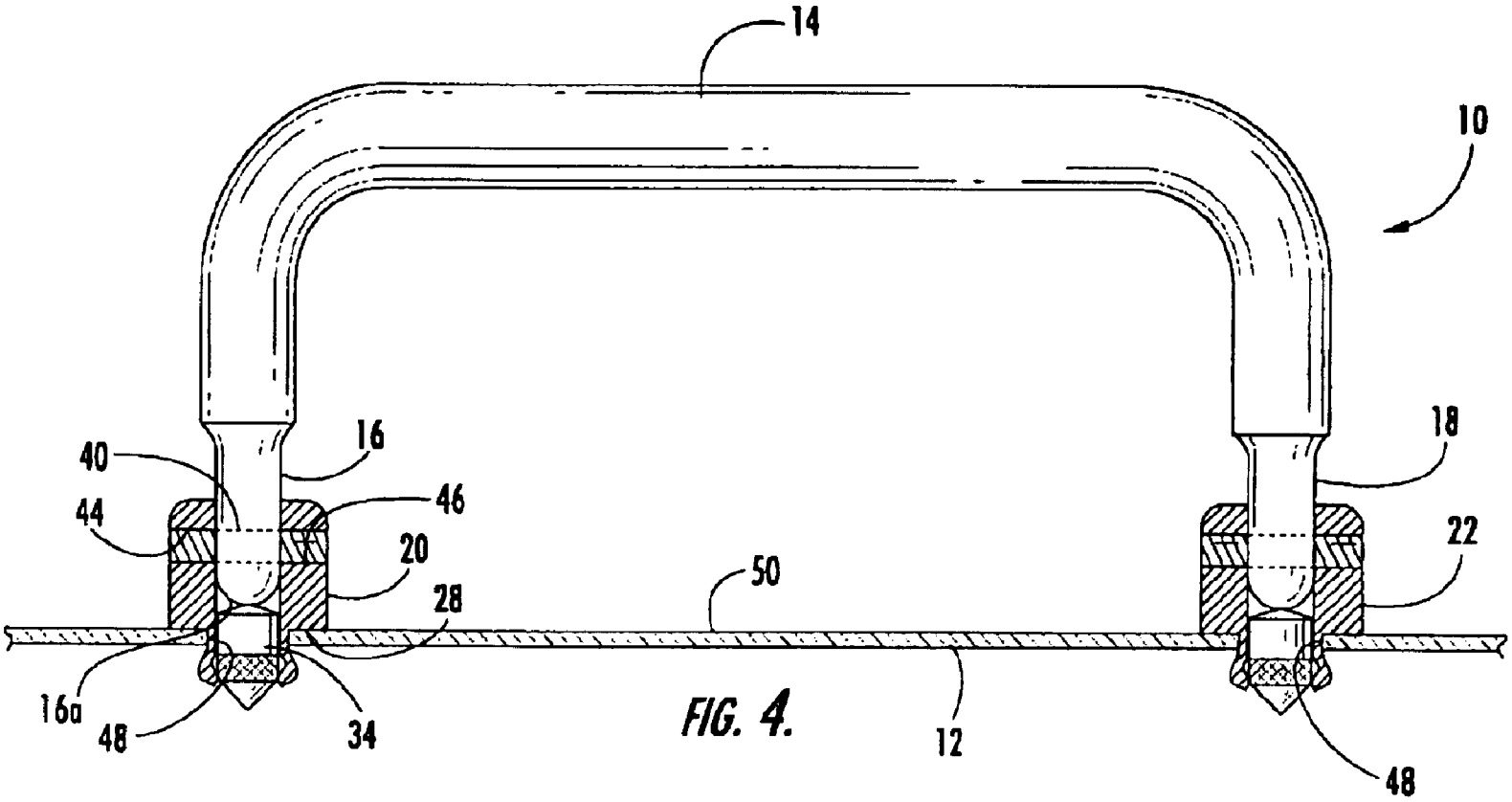
FIG. 4 is a front partial cross-sectional elevational view of the self-fastening handle in use.

As seen in FIGS. 2–4, the base member 20 includes a left transverse bore 44 and right transverse bore 46 that align with the transverse bore 40 through the free end 16 of the handle 14. When the handle 14 is arranged in the above-described parallel position, the lock pin 42 is routed through the left transverse bore 44, through the transverse bore 46 through the free end 16 of the handle 14 and then through the right transverse bore 46 through the base member 20. The aforesaid lock pin 42 and bore configuration is one of many different types of pivot constructions that can be employed to carry out the present invention. Other pivot configurations are intended to be within the scope of the present invention.

With the spreader pin 34 and handle 14 assembled as shown in FIG. 2, it may now be installed onto a carrier panel 12. On the carrier panel 12, an aperture 48 is provided therethrough that is dimensional to be slightly larger that the outer dimension of the arrangement of fingers 26 emanating downwardly from the base member 20. As can be understood, in the preferred embodiment with a handle 14 with two free ends 16, 18, two apertures 48 in the carrier panel 12 are provided to receiving corresponding two base members 20, 22. The fingers 26 are routed into their corresponding apertures 48 through the carrier panel 12 so that that bottom surface 28 of the base member 20 substantially communicates with the top surface 50 of the carrier panel 12.

While the base members 20, 22 are maintained in contact with the carrier panel 12, the handle 14 is pivoted as indicated by the arrow in FIG. 2. This pivoting action causes the rounded surface 16*a* of free end 16 of the handle 14 to bear against the impact surface 38 of the spreader pin 34. Driving of the spreader pin 34 is facilitated by the leverage created by the pivoting of the handle 14. The free end 16 is preferably rounded to facilitate bearing against the impact surface 38 of the spreader pin 34. Due to the location of the pivot point of the free end 16 of the handle 14, the spreader pin 34 is driven downwardly through the fingers 26, namely, the inwardly turned flanges 30. As shown in FIG. 3, upon rotation of the handle 14 an amount of 90 degrees, the spreader pin 34 is secured in place by the spring-like gripping of the fingers 26 via the inwardly turned flanges 30. Preferably, the sides 52 of the spreader pin 34 has a roughened surface to assist in maintaining the spreader pin 34 in communication with the flanges 30 of fingers 26.

With the spreader pin 34 fixed in place behind the carrier panel 12, it will not be possible for the base member 20 to be separated from the carrier panel 12 because the spread fingers 26 now have a dimension that is greater than the dimension of the aperture 48 through the carrier panel 12. Now that the spreader pin 34 has been installed and the base member 20 connected, the handle 14 can now freely pivot about the lock pin 42 for use as a handle 14 because the free end 16 of the handle 14 has clearance to pass by the impact surface 38 of the spreader pin 34. Thus, the pivot and free end 16 of the handle 14 are first employed to install the assembly to a carrier panel 12 and are then used to provide a pivoting handle 14 for normal use.

FIG. 4 shows a front elevational, partial cross-sectional view of the self-fastening handle assembly 10 of the preferred embodiment of the present invention. The handle assembly 10 includes a pair of free ends 16, 18 that are pivotally connected to a respective pair of base members 20, 22. Each of the base members 16, 18 are anchored to the carrier panel 12, as described above. As can be understood, both base members 20, 22 are installed simultaneously from a single pivot action of the bail handle 14.

Figure 5:
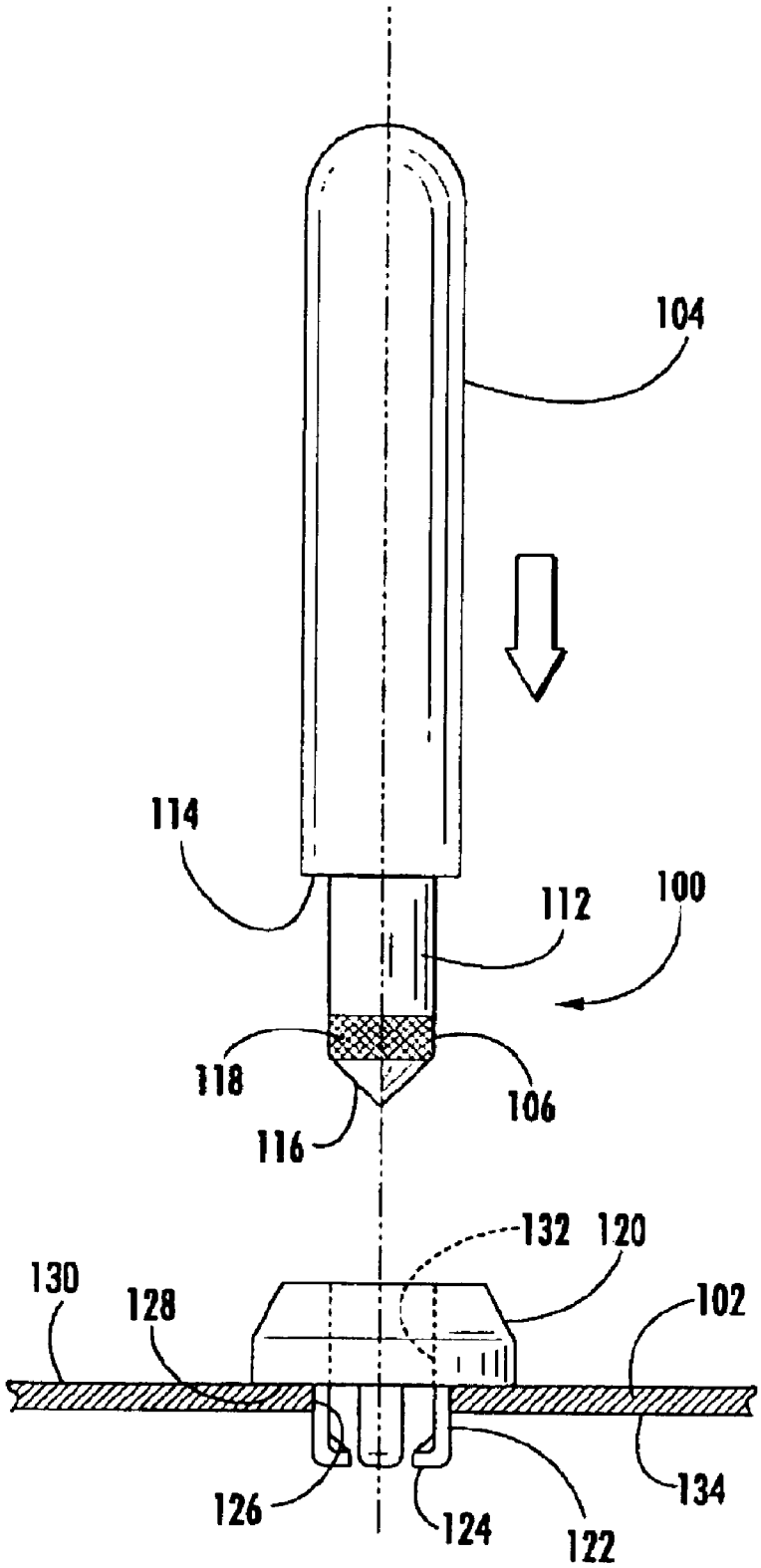
FIG. 5 is a partial cross-sectional view of an alternative embodiment of the self-fastening handle of the present invention in the process of being installed.
Figure 6:
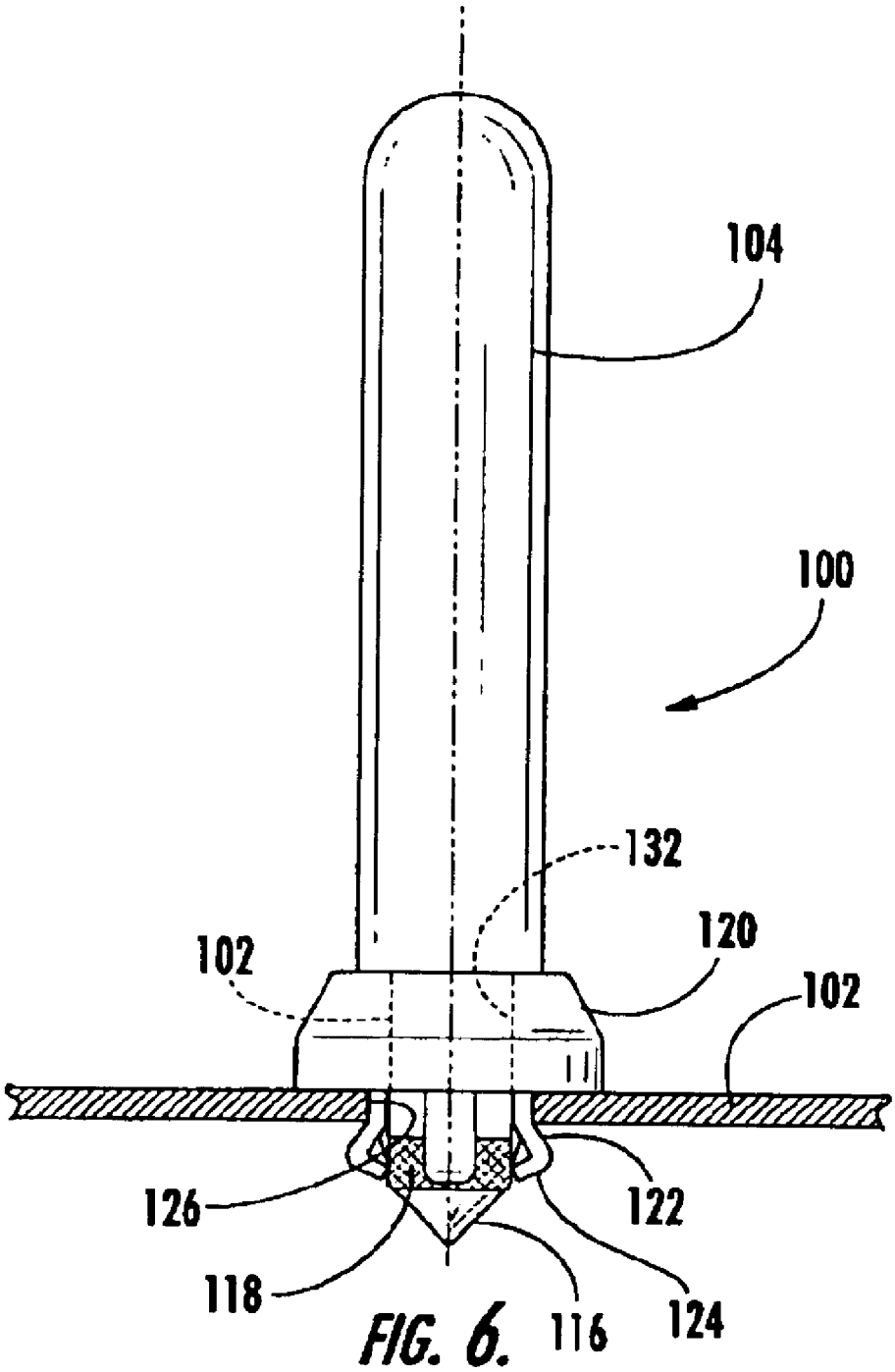
FIG. 6 is a partial cross-sectional view of the self-fastening handle of FIG. 5 fully installed.
Figure 7:
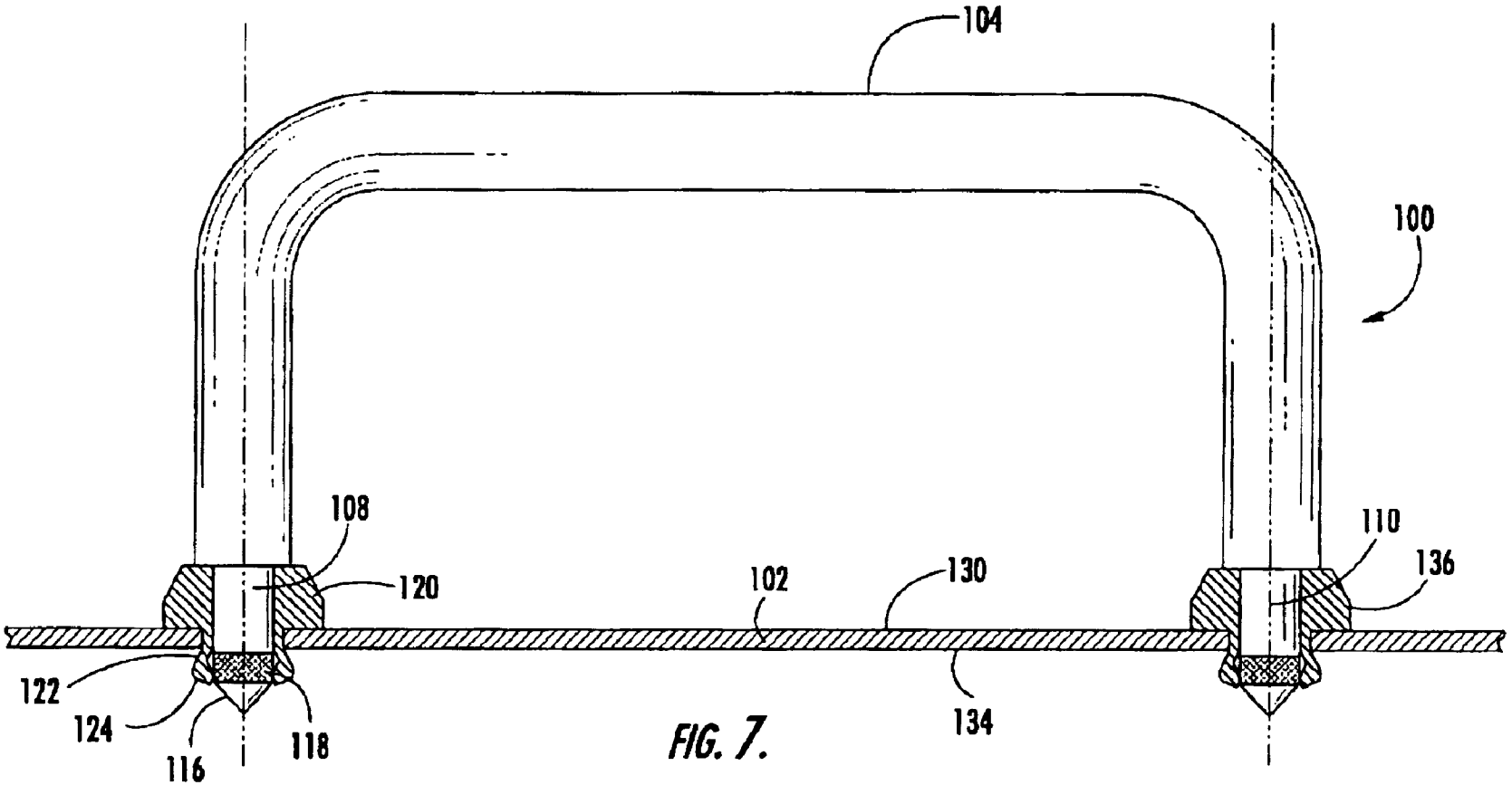
FIG. 7 is a front partial cross-sectional elevational view of the self-fastening handle of FIG. 5 in use.

Referring now to FIG. 5 alternative embodiment 100 of the present invention is shown in the process of being installed. In this embodiment 100, the free end 108 of the handle 104 and includes an integrated spreader pin 106. As seen in FIG. 7, the preferred configuration of the alternative embodiment 100 has a handle 104 with a bail configuration with two free ends 108, 110. For ease of discussion, connection of one of the free ends 108 to the carrier panel 102 will be discussed in detail. The other free end 110 is installed in an identical fashion.

The free end 108 of the handle 104 includes a reduced neck portion 112 with a shoulder 114 and a tapered tip 116. The side of the reduced neck portion 112 preferably has a roughened surface 118. The base member 120 is identical to the base member 20 of the preferred embodiment 100 of FIGS. 1–4 with a number of downwardly depending fingers 122 with inwardly turned flanges 124. The fingers 122 have a dimension that is slightly smaller than an aperture 126 in the carrier panel.

For installation, the base member 120 is positioned on the carrier panel 102 so that the fingers 122 reside it the aperture 126. While holding the base member 120 in place with the bottom surface 128 thereof in communication with the top surface 130 of the carrier panel 102, the handle 104 is pushed downwardly, in the direction of the arrow of FIG. 5, so that the tapered end 116 is routed through the central bore 132 of the base member 120.

By the downward pushing force of the handle 104, the reduced neck portion 112 of the handle 104 communicates with the inwardly turned flanges 124 of the fingers 122 to drive the fingers 122 outwardly underneath the rear side 134 of the carrier panel 102. The roughened surface 118 on the reduced neck portion 112 assists in maintaining the flanges 124 in place thus locking the base member 120 to the carrier panel 102 and the handle 104 attached thereto.

FIG. 7 shows a front elevational, partial cross-sectional view of the self-fastening handle assembly 100 of the alternative embodiment of the present invention. The handle assembly 100 includes a pair of free ends 108, 110 that are connected to a respective pair of base members 120, 136. Each of the base members 120, 136 are anchored to the carrier panel 102, as described above. As can be understood, both base members 120, 136 are installed simultaneously from a single push of the bail handle 104 in a single action.

In the alternative embodiment 100, in contrast to the preferred embodiment of FIGS. 1–4, the handle 104 is permanently attached to the carrier panel 102 via the support members 120, 136 in a position perpendicular to the top surface 130 of the carrier plate 102. In certain applications, the fixed non-pivoting handle of alternative embodiment 100 may be preferred over the pivoting handle 10 of the preferred embodiment.

The bail configuration of the present invention with two free ends is shown by way of example. More than two free ends may be employed to suit the application at hand. Moreover, a single free end with a single base member may be employed whereby a single pivot or single push permanently connected the handle to the carrier panel. The opposing end of the single free end could be a loop, ring, or the like instead of the bail configuration.

The handle assembly 10, 100, including the handle 14, 104, the base members 20, 22, 120, 136 and the spreader pin 34, of the present invention is preferably machined from metal, such as aluminum, however, other metals may be used. Further, the assemblies 10, 100 may be cast from metal as well or molded using a plastic material, or the like to suit the application at hand. While the foregoing method of manufacture and installation of the handle assemblies 10, 100 of the present invention is preferred, it is only one of many different methods that can be employed to carry out the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A self-fastening handle assembly, comprising:

a carrier panel having an aperture with a diameter therethrough;

a base member having a central bore and a bottom surface;

a plurality of fingers extending from the bottom surface of the base member; the fingers being in a first arrangement smaller than the diameter of the aperture and thereby capable of being routed through the aperture in the carrier panel; the fingers being expandable from the first arrangement to a second arrangement having a diameter greater than the diameter of the aperture;

a spreader pin residing within the bore and within the plurality of fingers; the spreader pin having a top surface and a finger engaging surface; the spreader pin movable from a first position with the fingers at the first arrangement to a second position within the fingers to a second arrangement with the finger engaging surface in communication with the fingers;

a handle pivotally connected to the base member by a pivot; the handle having a free user manipulatable end on one side of the pivot and an impact end on the opposing side of the pivot;

whereby rotation of the handle about the pivot, when the plurality of fingers reside in the aperture, impacts the impact end into the top surface of the spreader pin thereby securing the base member to the carrier panel and the handle pivotally connected thereto.

2. The assembly of claim 1, wherein the assembly is manufactured of aluminum.

3. The assembly of claim 1, wherein the plurality of fingers include inwardly tapered free ends facilitating movement from the first arrangement to the second arrangement.

4. The assembly of claim 1, wherein the impact end of the handle is rounded.

5. The assembly of claim 1, wherein the top surface of the spreader pin is rounded.

6. The assembly of claim 1, wherein the assembly includes a carrier panel with a pair of apertures capable of receiving a pair of base members respectively pivotally connected to a handle with a bail and two impact ends.

7. The assembly of claim 1, wherein the impact end of the handle impacts the top surface of the spreader pin to move the plurality of fingers from the first arrangement to the second arrangement upon rotation of the handle 90 degrees.

8. The assembly of claim 1, wherein the finger engaging surface is roughened to provide frictional engagement with the plurality of fingers.

9. A self-fastening handle assembly, comprising:

a carrier panel having an aperture with a diameter therethrough;

a base member having a central bore and a bottom surface;

a plurality of fingers extending from the bottom surface of the base member; the fingers being in a first arrangement smaller than the diameter of the aperture and thereby capable of being routed through the aperture in the carrier panel; the fingers being expandable from the first arrangement to a second arrangement having a diameter greater than the diameter of the aperture;

a handle routable into the central bore of the base member; the handle having a free user manipulatable end and a spreader end on the opposing side thereof; the spreader end being positionable within the plurality of fingers; the spreader end having a finger engaging surface; the spreader end being movable from a first position with the plurality of fingers at the first arrangement to a second position within the plurality of fingers to a second arrangement with the finger engaging surface in communication with the fingers;

whereby insertion of the spreader end of the handle into the central born of the base member, the finger engaging surface of the spreader end of the handle spreads the plurality of fingers thereby securing the base member to the carrier panel and the handle connected thereto.

10. The assembly of claim 9, wherein the assembly is manufactured of aluminum.

11. The assembly of claim 9, wherein the fingers include inwardly tapered free ends facilitating movement from the first arrangement to the second arrangement.

12. The assembly of claim 9, wherein the spreader end of the handle is rounded.

13. The assembly of claim 9, wherein the assembly includes a carrier panel with a pair of apertures capable of receiving a pair of base members respectively connected to a handle with a bail and two spreader ends.

14. The assembly of claim 9, wherein the finger engaging surface is roughened to provide frictonal engagement with the plurality of fingers.

15. A method of attaching a handle to a carrier panel, comprising the steps of:

providing a carrier panel having an aperture with a diameter therethrough;

providing a base member having a central bore and a bottom surface with a plurality of fingers extending from the bottom surface of the base member;

providing a spreader pin within the bore and within the plurality of fingers; the spreader pin having a top surface and a finger engaging surface; the spreader pin being movable from a first position with the fingers at the first arrangement to a second position within the fingers to a second arrangement with the finger engaging surface in communication with the fingers;

providing a handle pivotally connected to the base member by a pivot; the handle having a free user manipulatable end on one side of the pivot and an impact end on the opposing side of the pivot;

routing the fingers through the aperture in the carrier panel;

rotating the handle relative to the base member;

impacting the impact end of the handle into the spreader pin;

driving the spreader pin into the plurality of fingers;

spreading the plurality of fingers to the second arrangement which has a diameter greater than the diameter of the aperture in the carrier panel thereby preventing detachment of the base member from the carrier panel; and securing the base member to the carrier panel and the handle pivotally connected thereto.

16. The method of claim 15, wherein the assembly is manufactured of aluminum.

17. The method of claim 15, wherein the plurality of fingers include inwardly tapered free ends facilitating movement from the first arrangement to the second arrangement.

18. The method of claim 15, wherein the assembly further includes the step of:

providing a carrier panel with a pair of apertures capable of receiving a pair of base members respectively pivotally connected to a handle with a ball and two impact ends.

19. The method of claim 15, further comprising the step of: roughening the ringer engaging surface.

* * * * *